US006956187B2

(12) United States Patent
Kawamizu et al.

(10) Patent No.: US 6,956,187 B2
(45) Date of Patent: Oct. 18, 2005

(54) STEEL PLATE SPLICING FACILITY UTILIZING SHEAR JOINING

(75) Inventors: Tsutomu Kawamizu, Hiroshima (JP); Ritsuo Hashimoto, Hiroshima (JP); Etsurou Hirai, Hiroshima (JP); Shoichi Hashimoto, Hiroshima (JP); Kanji Hayashi, Hiroshima (JP)

(73) Assignees: Mitsubishi Heavy Industries, Ltd., Tokyo (JP); Mitsubishi-Hitachi Metals Machinery, Inc., Tokyo (JP)

( * ) Notice: Subject to any disclaimer, the term of this patent is extended or adjusted under 35 U.S.C. 154(b) by 0 days.

(21) Appl. No.: 10/463,785

(22) Filed: Jun. 18, 2003

(65) Prior Publication Data

US 2004/0035852 A1 Feb. 26, 2004

(30) Foreign Application Priority Data

Jul. 11, 2002 (JP) ..... 2002-202321

(51) Int. Cl.[7] ..... H05B 3/44

(52) U.S. Cl. ..... 219/544; 219/603; 228/141.1

(58) Field of Search ..... 219/544, 546, 219/602, 603, 83, 156; 228/125, 141.1, 5.7; 72/226, 229, 1.5; 148/645, 688

(56) References Cited

U.S. PATENT DOCUMENTS 3,806,697 A * 4/1974 Gray ..... 219/156
3,823,299 A * 7/1974 Metcalfe et al. ..... 219/83
3,835,681 A * 9/1974 Shumaker ..... 72/11.5
5,306,365 A * 4/1994 Reighard ..... 148/688
5,490,315 A * 2/1996 Kostopolos et al. ..... 29/527.7
6,152,352 A * 11/2000 Isoyama et al. ..... 228/125
6,182,490 B1 * 2/2001 Ginzburg et al. ..... 72/229
6,184,508 B1 * 2/2001 Isoyama et al. ..... 219/603
6,189,763 B1 * 2/2001 Tazoe et al. ..... 228/5.7
6,213,381 B1 * 4/2001 Funamoto et al. ..... 228/141.1
6,460,389 B1 * 10/2002 Ammerling et al. ..... 72/226
2003/0084972 A1 * 5/2003 Matsubara et al. ..... 148/645

FOREIGN PATENT DOCUMENTS

DE 1123879 B 2/1962
EP 0770434 A2 5/1997
JP 3-169420 A 7/1991
JP 6-39405 A 2/1994

* cited by examiner

*Primary Examiner*—Robin O. Evans
*Assistant Examiner*—Leonid M Fastovsky
(74) *Attorney, Agent, or Firm*—Birch, Stewart, Kolasch & Birch, LLP

(57) ABSTRACT

A steel plate splicing facility includes, a steel plate heating apparatus for retrieving and heating a preceding steel plate and a following steel plate, and a shear-joining apparatus for clamping a tail end portion of the preceding steel plate and a leading end portion of the following steel plate in an overlapping condition by a die and a clamp and shearing them with a punch, such that surfaces of the tail end portion and the leading end portion are newly formed and brought in contact with each other in order to them. The shear-joining apparatus joins the preceding and following steel plates at a temperature equal to or higher than 350° C. and at a percentage clearance c/t equal to or lower than 5%, c/t being defined by $c/t=D/(t_1+t_2)\times 100$ where D represents a distance between the punch and the die, and $t_1$ and $t_2$ represent a thickness of respective steel plates.

10 Claims, 10 Drawing Sheets

STEEL PLATE SPLICING FACILITY UTILIZING SHEAR JOINING

The entire disclosure of Japanese Patent Application No. 2002-202321 filed on Jul. 11, 2002 including specification, claims, drawings and summary is incorporated herein by reference in its entirety.

BACKGROUND OF THE INVENTION

1. Field of the Invention

The present invention relates to a steel plate splicing facility which utilizes shear joining. More particularly, the invention relates to a steel plate splicing facility adapted to join steel plates which have undergone hot rolling and are to undergo pickling, or pickling and cold rolling.

2. Description of the Related Art

Conventionally, as shown in FIGS. 16A and 16B, a steel plate (hereinafter may be referred to as a preceding material) 1 which is currently undergoing pickling, or pickling and cold rolling, and a steel plate (hereinafter may be referred to as a following material) 2 which is to next undergo pickling, or pickling and cold rolling are joined by, for example, flash butt processing or laser processing.

Specifically, the preceding material 1 passes through shears 10, a clamp apparatus 11, a joining apparatus 12 such as a laser welding machine or a flash butt joining machine, and a clamp apparatus 11; undergoes notch treatment and joint treatment; and is then sent to looper equipment and pickling equipment.

The preceding material 1 and the following material 2 are clamped by the corresponding clamp apparatus 11, and the following material 2 is laser-welded or flash butt-welded to the preceding material 1 by the joining apparatus 12.

Incidentally, a steel plate must be continuously conveyed at a predetermined speed, for the following reason. If travel of the steel plate stops while the steel plate is in a pickling bath, surface properties of the steel plate will be impaired by excessive pickling.

Since the conventional joining method involves long joining time, a large looper equipment (equipment for buffering a steel plate) must be installed, thereby raising a problem in that the size of the overall equipment becomes large.

SUMMARY OF THE INVENTION

The present invention provides a steel plate splicing facility, comprising a steel plate heating apparatus for retrieving a preceding steel plate from a first coil and heating the retrieved preceding material upon a shear-joining operation and for retrieving a following steel plate from a second coil and heating the retrieved following steel plate upon the shear-joining operation; and a shear-joining apparatus for clamping a tail end portion of the preceding steel plate and a leading end portion of the following steel plate in an overlapping condition by means of a die and a clamp and for shearing the tail end portion of the preceding steel plate and the leading end portion of the following steel plate by means of a punch in such a manner that surfaces of the tail end portion and the leading end portion that are newly formed as a result of the shearing are brought in contact with each other in order to join the leading end portion of the following steel plate to the tail end portion of the preceding steel plate, wherein the shear-joining apparatus joins the preceding steel plate and following steel plate at a temperature equal to or higher than 350° C. and at a percentage clearance c/t equal to or lower than 5%, the percentage clearance c/t being defined by $c/t=D/(t_1+t_2)\times 100$, where D represents a distance between the punch and the die, and $t_1$ and $t_2$ represent respective thicknesses of the preceding steel plate and the following steel plate as measured at a location where the preceding steel plate and the following steel plate overlap each other. Thus, in contrast to the conventional joining method such as flash butt processing and laser processing, surfaces to be joined can be of low accuracy, and joining time is very short, whereby the overall time of the joining process can be considerably reduced, and looper equipment can be simplified considerably. Further, by joining the preceding and following steel plates under the foregoing conditions, the strength of the joint is higher than that of a base steel plate.

The steel plate heating apparatus may comprise a device for heating the following steel plate through induction heating, and a device for nipping the preceding steel plate and the following steel plate by means of a heating clamp in order to heat the preceding steel plate and the following steel plate through contact heat conduction from the heating clamp, the heating clamp being preheated through induction heating. Thus, the preceding steel plate and the following steel plate can be reliably heated.

Alternatively, the steel plate heating apparatus may comprise a device for heating the following steel plate through induction heating, and a device for heating the preceding steel plate and the following steel plate in an overlapping condition through induction heating. In this case as well, the preceding steel plate and the following steel plate can be reliably heated.

Alternatively, the steel plate heating apparatus may comprise a device for heating the preceding steel plate and the following steel plate in an overlapping condition through induction heating. In this case as well, the preceding steel plate and the following steel plate can be reliably heated.

The shear-joining apparatus may perform joining such that a joint surface extends linearly or nonlinearly. In either case, newly-formed surfaces are reliably joined together.

The shear-joining apparatus may perform joining such that the steel plate on a side toward the punch is pressed by means of the punch so as to be joined to the other steel plate at an arbitrary number of positions along the width direction of the steel plate. Further, the shear-joining apparatus may perform joining such that the punch forms a cylindrical joint surface.

BRIEF DESCRIPTION OF THE DRAWINGS

FIGS. 1A and 1B are overall views of a steel plate splicing facility according to a first embodiment of the present invention, wherein FIG. 1A shows a state during joining, and FIG. 1B shows a state after joining;

FIGS. 5A and 5B are overall views of a steel plate splicing facility according to a second embodiment of the present invention, wherein FIG. 5A shows a state during joining, and FIG. 5B shows a state after joining;

FIGS. 9A and 9B are overall views of a steel plate splicing facility according to a third embodiment of the present invention, wherein FIG. 9A shows a state during joining, and FIG. 9B shows a state after joining;

FIGS. 16A and 16B are overall views of a conventional steel plate splicing facility, wherein FIG. 16A shows a state during joining, and FIG. 16B shows a state after joining.

DESCRIPTION OF THE INVENTION

Embodiments of the present invention will next be described in detail with reference to the drawings.

First Embodiment

FIGS. 1A, 1B, 2, 3, and 4 show a steel plate splicing facility according to a first embodiment of the present invention.

Figure 1A:
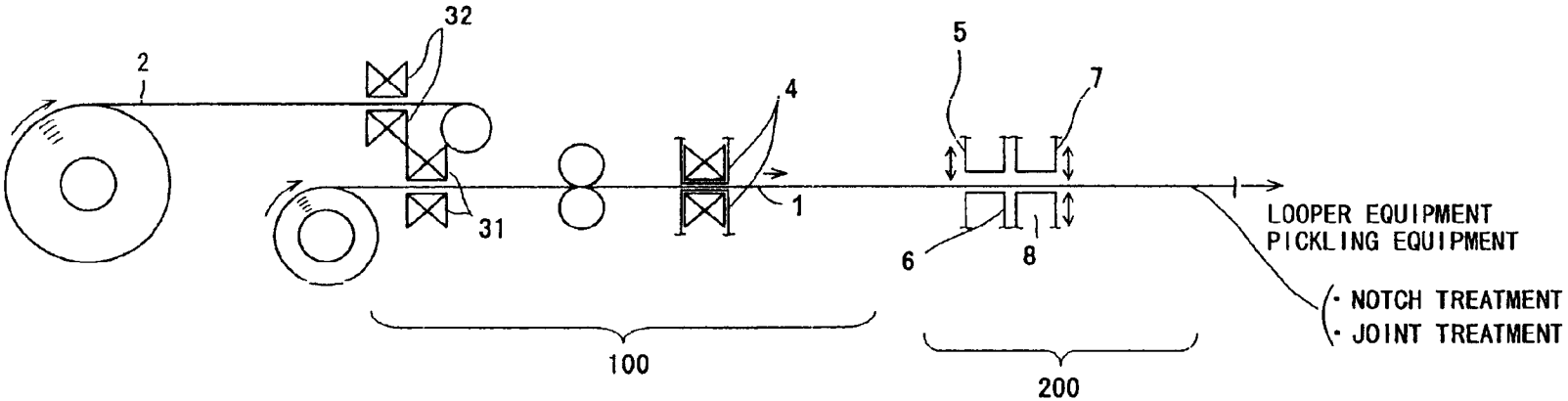
Figure 1B:
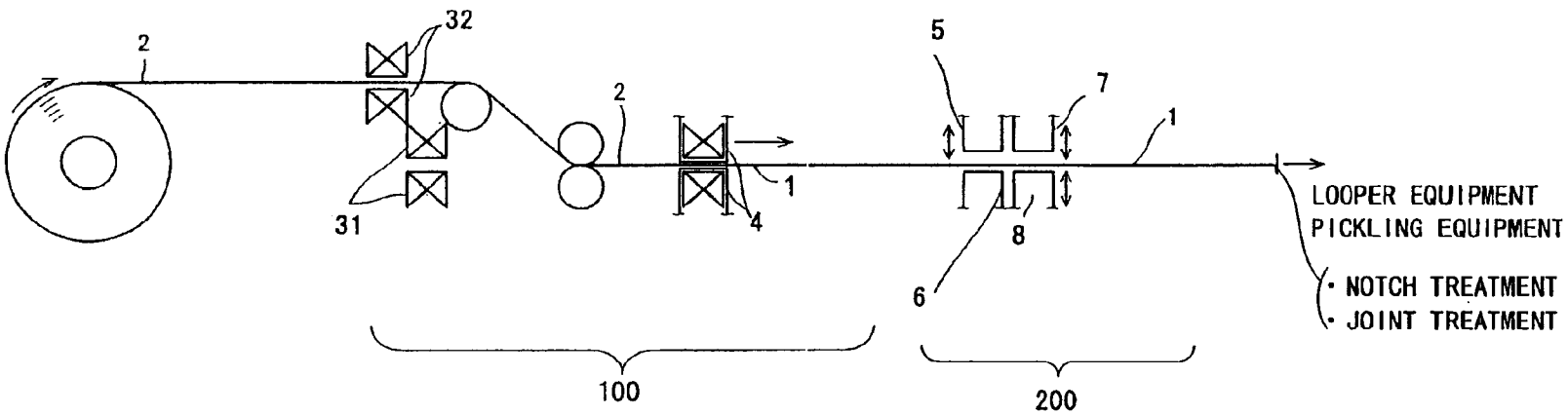

As shown in FIGS. 1A and 1B, the steel plate splicing facility according to the present embodiment includes a steel plate heating apparatus 100 and a shear-joining apparatus 200. A steel plate 1 having passed through the shear-joining apparatus 200 undergoes notch treatment and joint treatment, and is then sent to looper equipment and pickling equipment as in the conventional facility.

Figure 2:
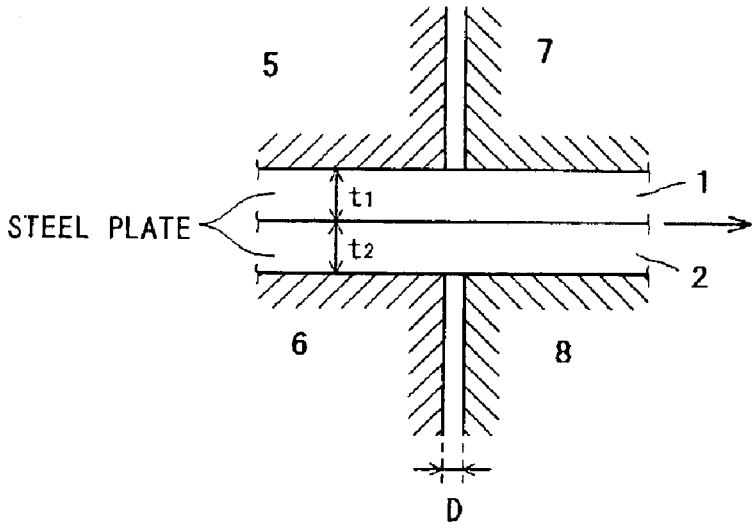
FIG. 2 is an explanatory view showing a shear-joining apparatus (as viewed before joining) according to the first embodiment.
Figure 3:
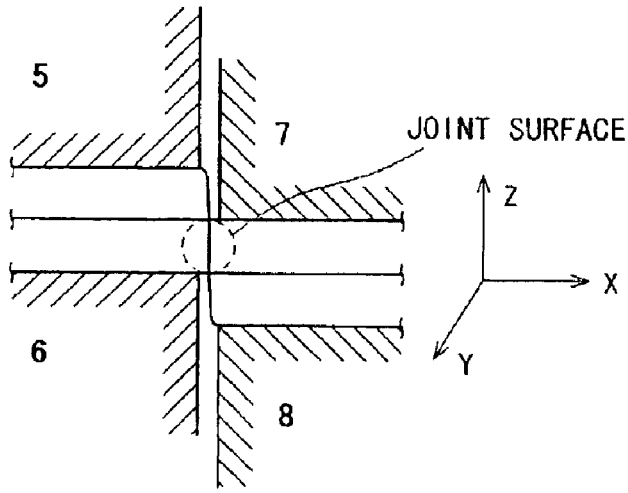
FIG. 3 is an explanatory view showing the shear-joining apparatus (as viewed after joining) according to the first embodiment.
Figure 4:
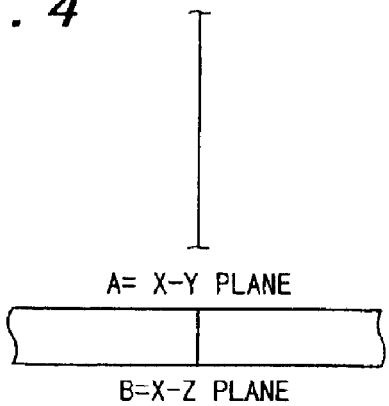
FIG. 4 is an explanatory view showing a joint surface according to the first embodiment.

In FIGS. 2 and 3, the preceding material overlies the following material. However, the positional relationship between the preceding and following materials is not limited thereto; i.e., the following material may overlie the preceding material. FIGS. 2 to 4 show the conditions of the preceding and following materials in the process of and after joining as viewed on a cross section taken along the thickness of a steel plate (as viewed on the X-Z plane).

In FIGS. 1A and 1B, the clamp, punch, and punch-backing member are vertically movable, and the die is stationary. However, the die is not necessarily stationary, but may be vertically movable under certain conditions.

The steel plate heating apparatus 100 includes a following-material heating apparatus 31, a following-material heating apparatus 32, and a preceding-material/following-material heating apparatus 4, and is adapted to heat steel plates 1 and 2 to a predetermined temperature.

Herein, the expression "to heat to a predetermined temperature" means, for example, that a steel plate of the atmospheric temperature (about 30° C.) can be heated to a temperature of 1,000° C. or higher.

The following-material heating apparatus 31 is adapted to heat, through induction heating, a leading end portion of a steel plate (hereinafter referred to as a preceding material) 1 which is currently undergoing pickling, or pickling and cold rolling. The following-material heating apparatus 32 is adapted to heat, through induction heating, a leading end portion of a next steel plate (hereinafter referred to as a following material) 2 which is to undergo pickling, or pickling and cold rolling.

A method for heating the preceding material 1 is not limited to induction heating as illustrated in FIGS. 1A and 1B. The preceding material 1 may be heated through direct or radiant heating by use of a burner or through contact heat conduction from a heating body. This also applies to heating of the following material 2.

After the following material 2 is heated, a tail end portion of the preceding material 1 and a leading end portion of the following material 2 are superposed on each other. The heating apparatus 4 grips the preceding material 1 and the following material 2 at the overlap portion and heats the overlap portion through contact heat conduction. The heating apparatus 4 is a heating clamp (a high-temperature member), which is preheated to a predetermined temperature through induction heating.

The heating apparatus 4 does not necessarily need to perform contact heat conduction, but may perform induction heating or heating with, for example, a burner.

The following material 2 may be heated in the present process instead of being heated in a separate process.

The shear-joining apparatus 200 includes a stationary die 6, a clamp 5, which is vertically movable in relation to the die 6, a vertically movable punch 7, and a punch-backing member 8.

As shown in FIG. 2, an overlap portion of the preceding material 1 and the following material 2 is gripped between the die 6 and the clamp 5 through movement of the clamp 5 toward the die 6, and the punch 7 is pressed down toward the punch-backing member 8 for punching. As a result, at the overlap portion of the two steel plates, the punch 7 causes a fracture surface of one steel plate to be brought in contact with a fracture surface of the other steel plate.

In FIG. 2, the preceding material overlies the following material. However, the positional relationship between the preceding and following materials is not limited thereto; i.e., the following material may overlie the preceding material.

As shown in FIG. 3, after being heated, the tail end portion of the preceding material 1 and the leading end portion of the following material 2 are sheared, and the respective newly-formed surfaces form a joint surface (marked with the broken line in FIG. 3). The newly-formed surfaces come into contact with each other at high temperature without presence of impurities such as an oxide film therebetween. Such impurities are usually present on the surface of a steel plate at high temperature.

As shown in FIG. 2, according to the present embodiment, the newly-formed surfaces come into contact with each other at high temperature as a result of subjection to pressing forces induced in the X direction or radially by the clamp 5, the punch 7, the punch-backing member 8, and the die 6, to thereby be joined together through diffusion of metal atoms.

The punch 7 and the die 6 used in the present embodiment are formed such that, as shown in FIG. 4, the joint surface extends linearly as viewed on the X-Y plane.

Figure 13:
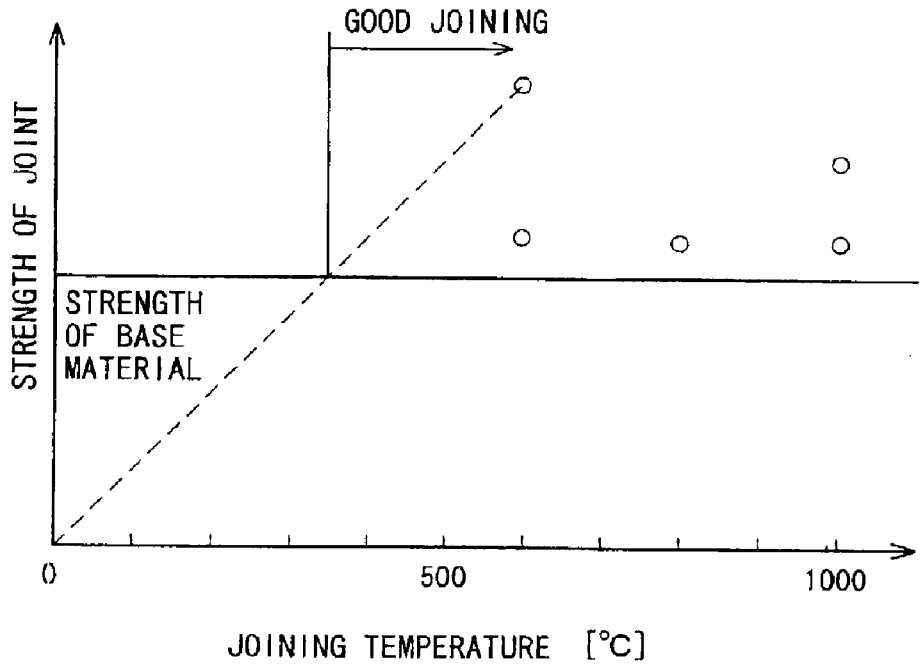
FIG. 13 is a graph showing the relationship between the strength of a joint and joining temperature (steel plate temperature)
Figure 14:
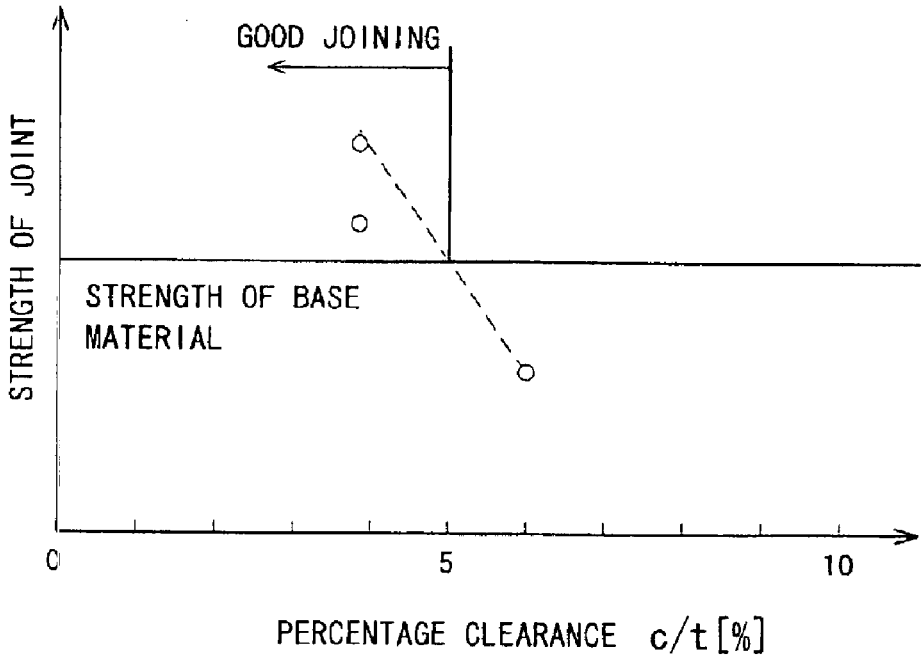
FIG. 14 is a graph showing the relationship between the strength of a joint and percentage clearance.

The steel plate splicing facility according to the present embodiment was tested by use of steel plates. The results of the test are shown in FIG. 13. As shown in FIG. 13, at a steel plate temperature equal to or higher than 350° C., a joint is formed under good conditions such that the strength of the joint is higher than that of a base material. Also, as shown in FIG. 14, when the percentage clearance c/t defined below by Eq. (1) is equal to or lower than 5%, a joint is formed under good conditions such that the strength of the joint is higher than that of the base material.

The expression "good joining" appearing in FIGS. 13 and 14 means that the strength of a joint is equal to or higher than that of the base material and does not allow the steel plate to fracture when the steel plate undergoes pickling, or pickling and cold rolling. The strength of the base material varies depending on the base material and is peculiar to the base material. However, since the test has revealed that, at a steel plate temperature equal to or higher than 350° C. and at a percentage clearance c/t equal to or lower than 5%, the strength of a joint becomes equal to or higher than that of the base material, the present invention specifies the steel plate temperature and the percentage clearance c/t as 350° C. or higher and 5% or lower, respectively. Notably, the strength of the base material is the tensile strength of the base material. FIG. 13 shows the results of the test in which the strength of a joint was tested while the temperature of a steel plate at the time of joining was varied as a parameter. FIG. 14 shows the results of the test in which the strength of a joint was tested while the percentage clearance c/t at the time of joining was varied as a parameter.

$$c/t=D/(t_1+t_2)\times 100 \quad (1)$$

where D is the clearance in the X direction between the punch 7 and the die 6, and $t_1$ and $t_2$ are the thickness of the preceding material 1 and that of the following material 2, respectively, as measured at their overlap portion.

Figure 15A:
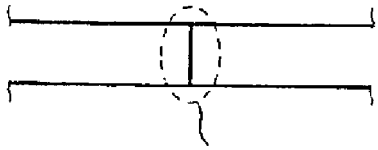
FIGS. 15A and 15B are views schematically showing a conventional splicing method and a splicing method according to the present invention, respectively.
Figure 15B:
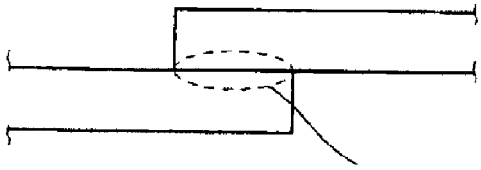
Figure 16A:
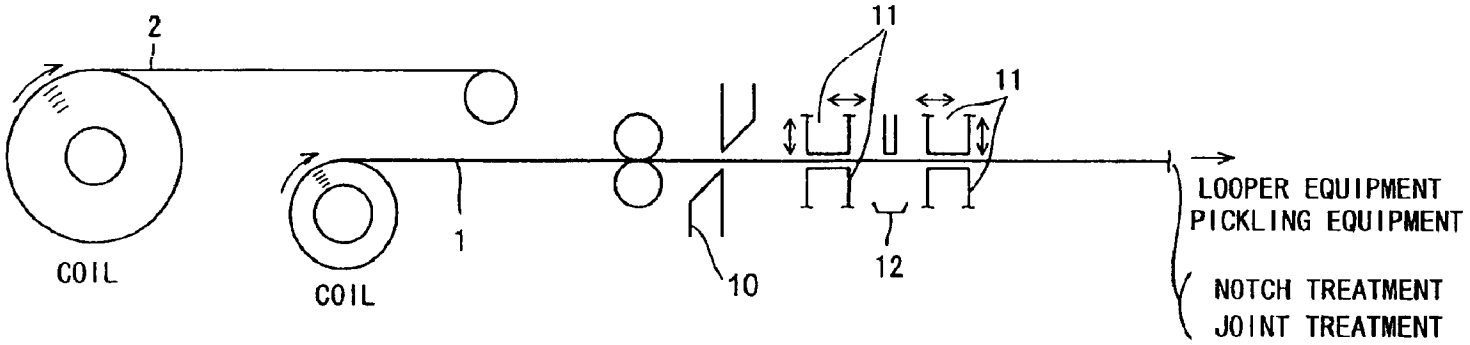
FIG. 16A PRIOR ART
Figure 16B:
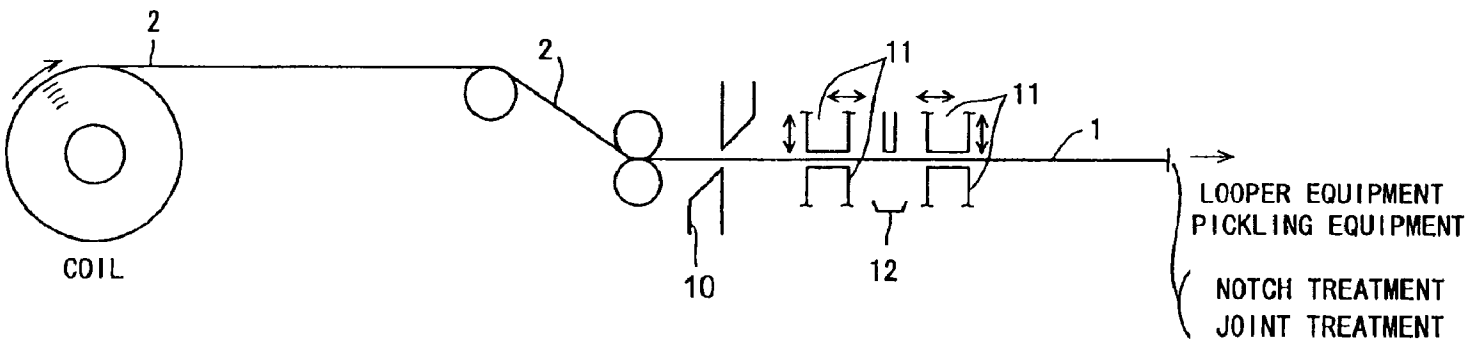
FIG. 16B PRIOR ART

As shown in FIGS. 15A and 15B, in contrast to the conventional joining method such as flash butt processing and laser processing, the method of joining the steel plates according to the present embodiment is advantageous in that surfaces to be joined can be of low accuracy, and joining time is very short, specifically one second or less. Thus, the overall time of the joining process can be considerably reduced, and looper equipment can be simplified considerably.

Specifically, according to the conventional method, as marked with the broken line in FIG. 15A, a leading end surface of the following material and a tail end surface of the preceding material butt to each other; thus, preparation for joining consumes about 25 seconds. By contrast, according to the present embodiment, as marked with the broken line in FIG. 15B, a leading end portion of the following material and a tail end portion of the preceding material are superposed on each other; thus, preparation time for joining is considerably reduced from 25 seconds.

Furthermore, since the conventional method employs a flash butt processing, in which voltage is applied to the entire end surfaces, or a laser processing, in which a laser head is moved, joining time is as long as about 10 seconds. By contrast, according to the present embodiment, joining time is time that the punch 7 consumes for punching (one second or less), and is thus short.

Second Embodiment

FIGS. 5A, 5B, 6, 7, and 8 show a steel plate splicing facility according to a second embodiment of the present invention.

Figure 6:
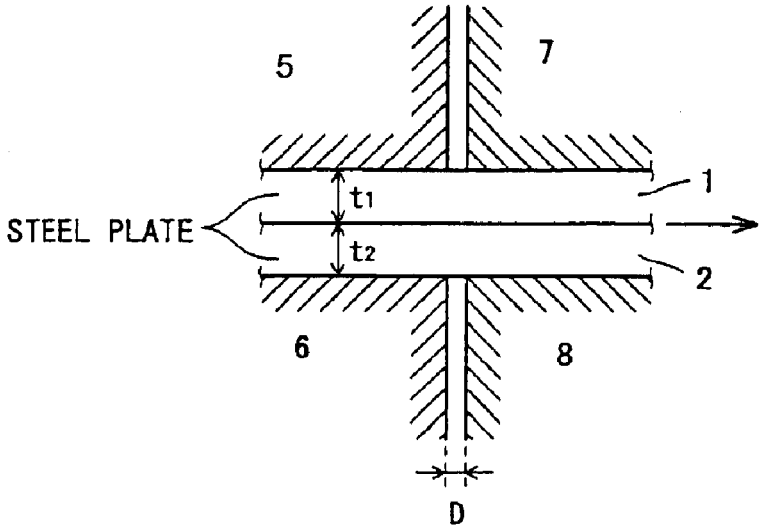
FIG. 6 is an explanatory view showing a shear-joining apparatus (as viewed before joining) according to the second embodiment.
Figure 7:
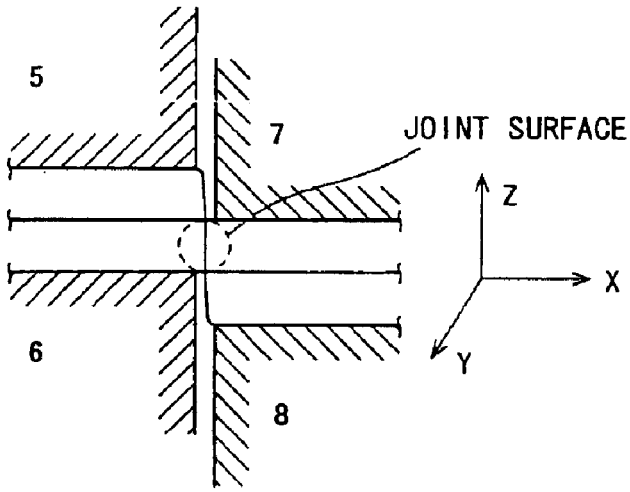
FIG. 7 is an explanatory view showing the shear-joining apparatus (as viewed after joining) according to the second embodiment.
Figure 8:
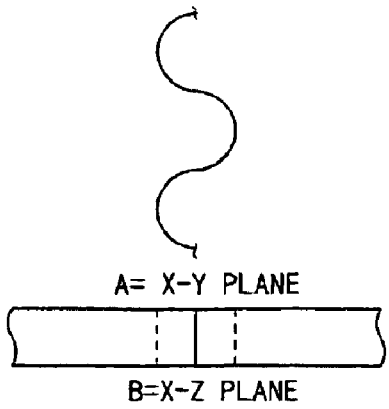
FIG. 8 is an explanatory view showing a joint surface according to the second embodiment.

In FIGS. 6 and 7, the preceding material overlies the following material. However, the positional relationship between the preceding and following materials is not limited thereto; i.e., the following material may overlie the preceding material. FIGS. 6 to 8 show the condition of the preceding and following materials in the process of and after joining as viewed on a cross section taken along the thickness of a steel plate (as viewed on the X-Z plane). Notably, in order to explain the condition of a joint along the width direction of a steel plate, FIG. 8 includes a view showing the X-Y plane as viewed from above the steel plate.

Figure 5A:
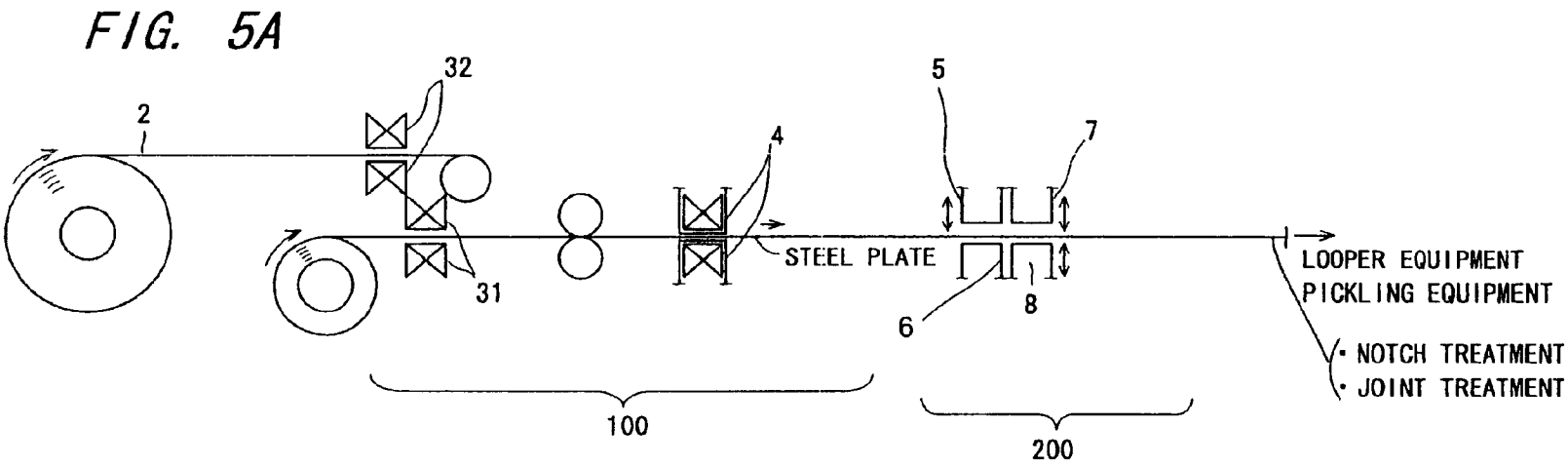
Figure 5B:
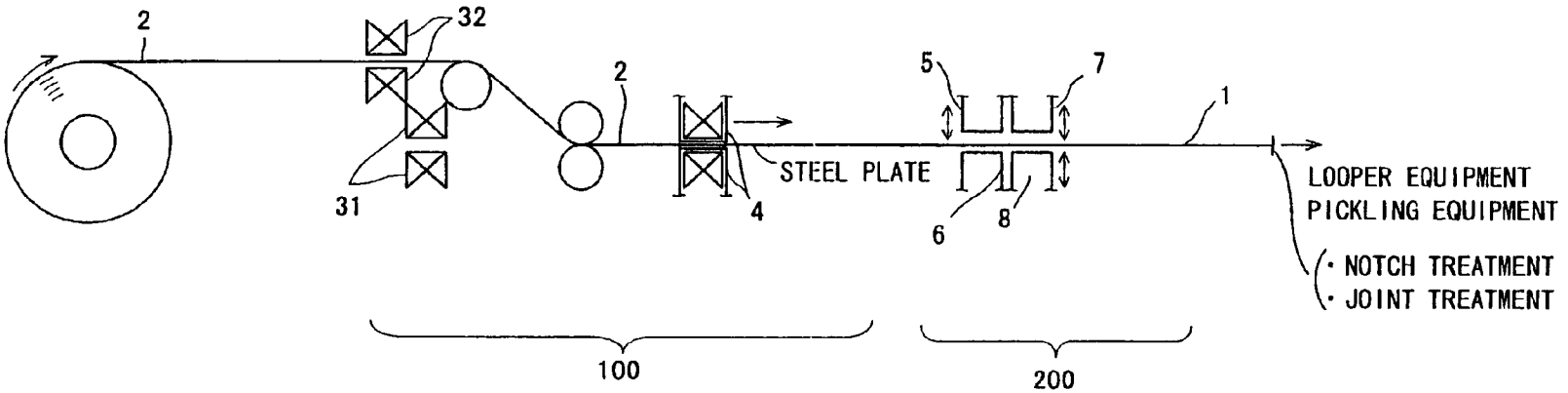

In FIGS. 5A and 5B, the clamp, punch, and punch-backing member are vertically movable, and the die is stationary. However, the die is not necessarily stationary, but may be vertically movable under certain conditions.

As shown in FIGS. 5A and 5B, the steel plate splicing facility according to the present embodiment assumes a basic configuration similar to that of the first embodiment and differs from the first embodiment in that, as shown in FIG. 8, the joint surface extends along a curved or rectangularly bent line as viewed on the X-Y plane.

The punch 7 and the die 6 used in the present embodiment are formed such that the joint surface assumes the above-mentioned profile. The other structural feature of the present embodiment is similar to that of the first embodiment.

Thus, also in the present embodiment, as shown in FIG. 6, an overlap portion of the preceding material 1 and the following material 2 is gripped between the die 6 and the clamp 5 through movement of the clamp 5 toward the die 6, and the punch 7 is pressed down toward the punch-backing member 8 for punching. As a result, at the overlap portion of the two steel plates, the punch 7 causes a fracture surface of one steel plate to be brought in contact with a fracture surface of the other steel plate.

As shown in FIG. 7, after being heated, a tail end portion of the preceding material 1 and a leading end portion of the following material 2 are sheared, and the respective newly-formed surfaces form a joint surface (marked with the broken line in FIG. 7). The newly-formed surfaces come into contact with each other at high temperature without presence of impurities such as an oxide film therebetween. Such impurities are usually present on the surface of a steel plate at high temperature.

As in the case of the first embodiment, the present embodiment is also characterized in that, at a steel plate temperature equal to or higher than 350° C., a joint is formed under good conditions such that the strength of the joint is higher than that of a base material and that, when the percentage clearance c/t defined above by Eq. (1) is equal to or lower than 5%, a joint is formed under good conditions such that the strength of the joint is higher than that of the base material.

Third Embodiment

FIGS. 9A, 9B, 10, 11A, and 11B show a steel plate splicing facility according to a third embodiment of the present invention.

Figure 10:
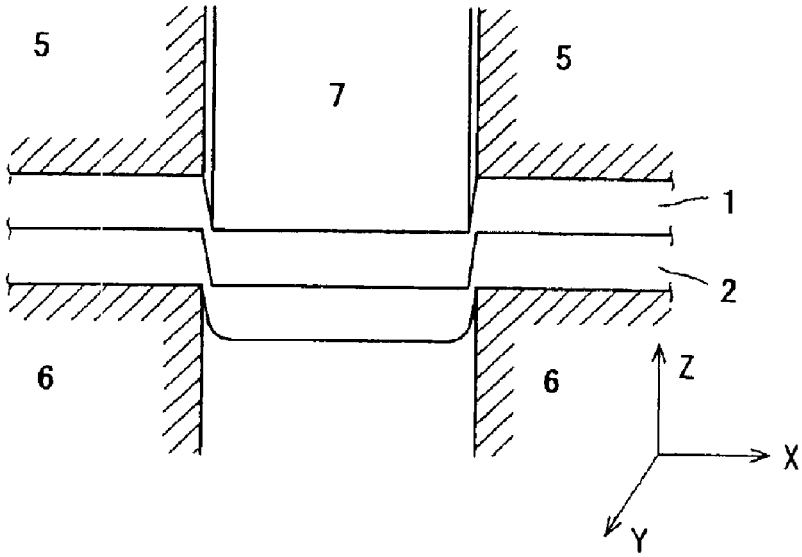
FIG. 10 is an explanatory view showing a shear-joining apparatus (as viewed after joining) according to the third embodiment.

In FIG. 10, the preceding material overlies the following material. However, the positional relationship between the preceding and following materials is not limited thereto; i.e., the following material may overlie the preceding material.

Figure 11A:
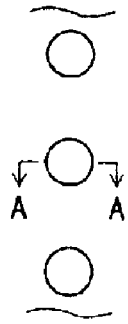
FIGS. 11A and 11B are explanatory views showing a joint surface according to the third embodiment.
Figure 11B:
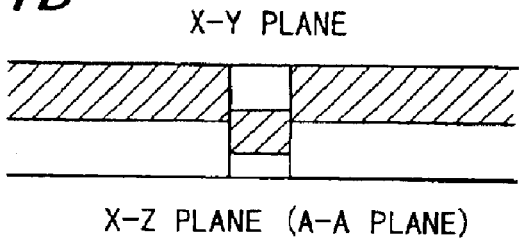
Figure 12B:
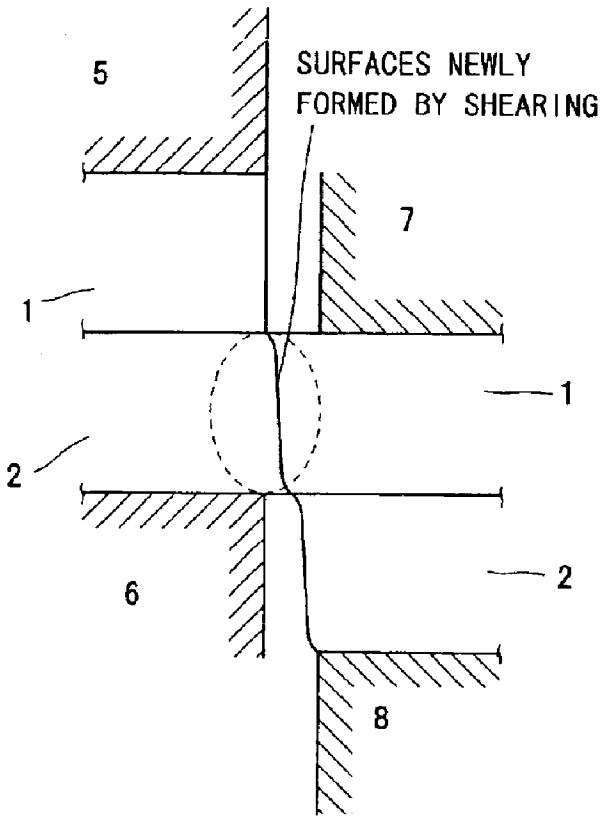
FIGS. 12A and 12B are explanatory view showing the shearing operation according to the first embodiment.
Figure 12A:
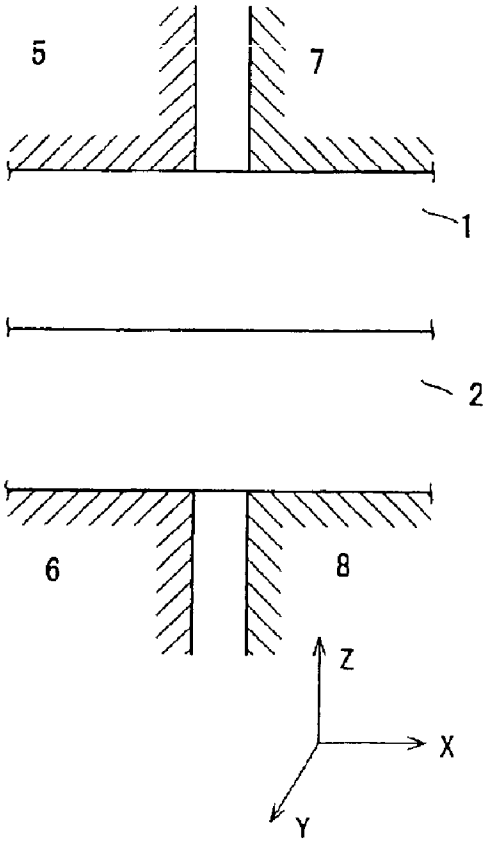

FIGS. 10, 11A, and 11B show the conditions of the preceding and following materials in the process of and after joining as viewed on a cross section taken along the thickness of a steel plate (as viewed on the X-Z plane). Notably, in order to explain the condition of a joint along the width direction of a steel plate, FIG. 11A shows a view of the X-Y plane as viewed from above the steel plate.

Figure 9A:
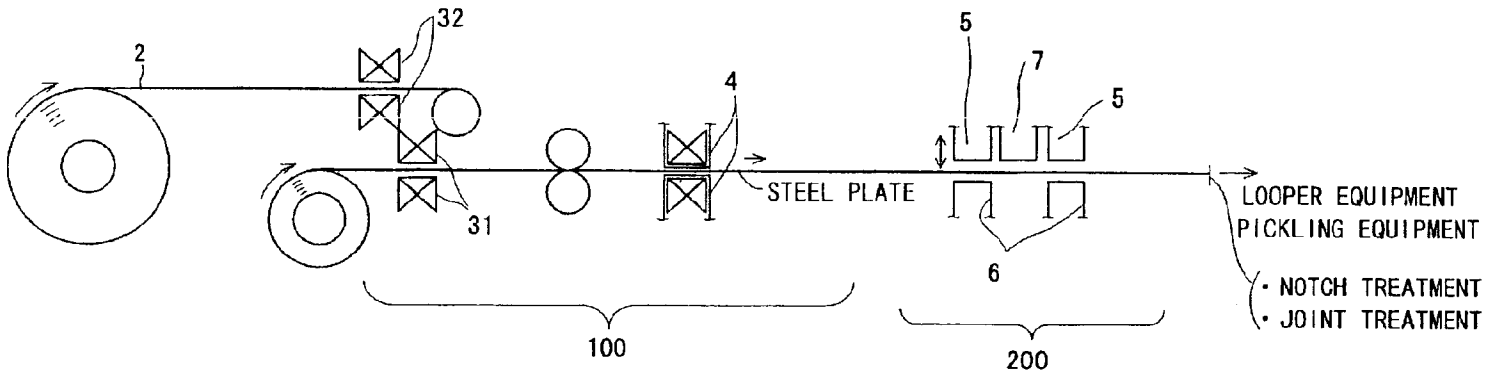
Figure 9B:
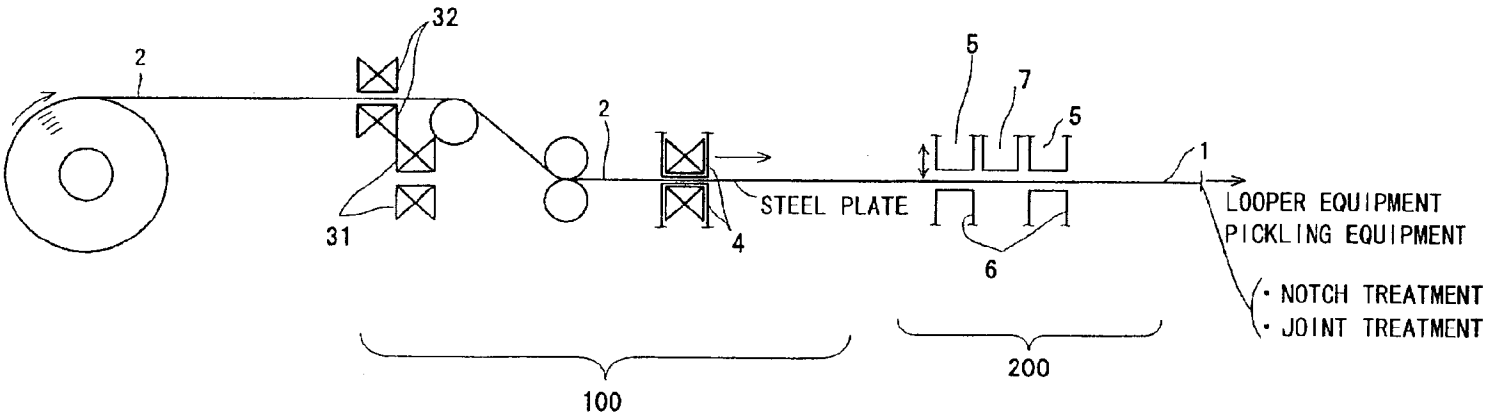

In FIGS. 9A and 9B, the clamp, punch, and punch-backing member are vertically movable, and the die is stationary. However, the die is not necessarily stationary, but may be vertically movable under certain conditions.

As shown in FIGS. 9A and 9B, the steel plate splicing facility according to the present embodiment assumes a basic configuration similar to that of the first embodiment and differs from the first embodiment in that, as shown in FIGS. 11A and 11B, an arbitrary number of joint surfaces are present along the width direction of the steel plates (along the Y direction); i.e., the joint surface is not continuously present along the width direction of the steel plates.

Thus, according to the present embodiment, a shear-joining apparatus 200 is configured such that a vertically movable punch 7 is sandwiched between two clamps 5 which are vertically movable in relation to corresponding stationary dies 6. As shown in FIG. 10, the punch 7 is pressed down so as to shear the preceding material 1 and the following material 2, whereby the respective newly-formed surfaces are joined together.

As in the case of the first embodiment, the present embodiment is also characterized in that, at a steel plate temperature equal to or higher than 350° C., a joint is formed under good conditions such that the strength of the joint is higher than that of base material and that, when the percentage clearance c/t defined above by Eq. (1) is equal to or lower than 5%, a joint is formed under good conditions such that the strength of the joint is higher than that of base material.

In the present embodiment, a joint has a cylindrical joint surface. However, the present invention is not limited thereto. The joint surface may have any shape such as a rectangular shape.

What is claimed is:

1. A steel plate splicing facility comprising:

a steel plate heating apparatus structured and arranged for retrieving a preceding steel plate from a first coil and heating the retrieved preceding steel plate upon a shear-joining operation and for retrieving a following steel plate from a second coil and heating the retrieved following steel plate upon the shear-joining operation; and a shear-joining apparatus structured and arranged for clamping a tail end portion of the preceding steel plate and a leading end portion of the following steel plate in an overlapping condition by means of a die and a clamp and for shearing the tail end portion of the preceding steel plate and the leading end portion of the following steel plate by means of a punch in such a manner that surfaces of the tail end portion and the leading end portion that are newly formed as a result of the shearing are brought in contact with each other in order to join the leading end portion of the following steel plate to the tail end portion of the preceding steel plate;

wherein the shear-joining apparatus is structured and arranged so that the apparatus joins the steel plate and the following steel plate at a temperature equal to or higher than 350° C. and at a percentage clearance c/t equal to or lower than 5%, the percentage clearance c/t being defined by $$c/t=D/(t_1+t_2)\times 100$$

where D represents a distance between the punch and the die, and $t_1$ and $t_2$ represent respective thicknesses of the preceding steel plate and the following steel plate as measured at a location where the preceding steel plate and the following steel plate overlap each other.

2. The steel plate splicing facility according to claim 1, wherein the steel plate heating apparatus includes, a device for heating the following steel plate through induction heating, and a device for nipping the preceding steel plate and the following steel plate by means of a heating clamp in order to heat the preceding steel plate and the following steel plate through contact heat conduction from the heating clamp, the heating clamp being preheated through induction heating.

3. The steel plate splicing facility according to claim 1, wherein the steel plate heating apparatus includes, a device for heating the following steel plate through induction heating, and a device for heating the preceding steel plate and the following steel plate in an overlapping condition through induction heating.

4. The steel plate splicing facility according to claim 1, wherein the steel plate heating apparatus includes a device for heating the preceding steel plate and the following steel plate in an overlapping condition through induction heating.

5. The steel plate splicing facility according to claim 1, wherein the shear-joining apparatus joins the preceding steel plate and the following steel plate such that a joint surface extends linearly.

6. The steel plate splicing facility according to claim 1, wherein the shear-joining apparatus joins the preceding steel plate and the following steel plate such that a joint surface extends nonlinearly.

7. The steel plate splicing facility according to claim 1, wherein the shear-joining apparatus joins the preceding steel plate and the following steel plate such that a joint surface extends nonlinearly.

8. The steel plate splicing facility according to claim 1, wherein the shear-joining apparatus joins the preceding steel plate and the following steel plate such that one of the preceding steel plate and the following steel plate on a side toward the punch in pressed by means of the punch so as to be joined to the other of the preceding steel plate and the direction of the preceding steel plate and the following steel plate.

9. The steel plate splicing facility according to claim 1 or 8, wherein the shear-joining apparatus joins the preceding steel plate and the following steel plate such that the punch forms a cylindrical joint surface.

10. The steel plate splicing facility according to claim 1, wherein the preceding steel plate and the following steel plate undergo pickling or pickling and cold rolling.

* * * * *